United States Patent [19]

Gräf

[11] 4,032,016

[45] June 28, 1977

[54] MOBILE CRANE WITH MEANS FOR EQUALIZING THE AXLE LOAD

[75] Inventor: Wilfried Gräf, Dortmund, Germany

[73] Assignee: O & K Orenstein & Koppel Aktiengesellschaft, Berlin, Germany

[22] Filed: Feb. 23, 1976

[21] Appl. No.: 660,359

[30] Foreign Application Priority Data

Feb. 21, 1975 Germany ..... 2507476

[52] U.S. Cl. ..... 212/49; 214/142

[51] Int. Cl.[2] ..... B66C 23/72

[58] Field of Search ..... 137/354, 265, 572; 37/190; 172/790, 786, 787; 214/142; 212/48, 49, 58 R, 59 R; 280/5 R, 285

[56] References Cited

UNITED STATES PATENTS

| | | | |
|---|---|---|---|
| 1,000,152 | 8/1911 | Correll | 114/125 |
| 2,986,407 | 5/1961 | Krueger | 212/49 |
| 3,897,109 | 7/1975 | Satterwhite | 37/190 |

*Primary Examiner*—Lawrence J. Oresky
*Attorney, Agent, or Firm*—Walter Becker

[57] ABSTRACT

A mobile crane in which the front section of a lower carriage is provided with first fluid storage container, and in which an upper carriage has a first end section with an operator's stand and a second end section with second fluid storage container. A pump is provided which is operable by motor which may also form at least a part of the drive for the crane. This pump is adapted to pump fluid from the first fluid storage container to the second fluid storage container to serve as counterweight during hoisting operations of the crane. When the crane is to be moved over roads, the fluid from the second fluid container can selectively be released to the first fluid container for equalizing axle loads.

6 Claims, 4 Drawing Figures

MOBILE CRANE WITH MEANS FOR EQUALIZING THE AXLE LOAD

The present invention relates to a device for equalizing the axial load of a mobile crane. A heretofore arrangement has become known for a detachable suspension of a counter weight for a movable boom crane which is provided with holding means by means of which the counter weight is additionally connected to the already provided weight. This additional weight, however, cannot be carried by the carrier vehicle during transport along roads because the axle load exceeds the height prescribed for transport on streets. The magnitude of the counter weight is limited by the rear pivoting radius and the contours of the driver's cab of the lower carriage. This results in a distance of the overall center of gravity with regard to the driving path which distance is unfavorable to the driving behavior of the mobile crane.

According to a further heretofore known arrangement, the counter weight is movably arranged laterally with regard to the upper carriage of the crane and is movably by means of rails and holding means. The displacement is effected by means of hydraulically operable telescopical cylinder-piston systems. This known arrangement requires a great number of parts as for instance hydraulic telescopic cylinders adapted to move inwardly and outwardly and also requires mechanical guiding means for the counter weight. Moreover, the overall center of gravity is located rather high which represents a negative feature, in particular when the crane has to move through streets.

It is, therefore, an object of the present invention to provide a device for equalizing the axle loads of a mobile crane, while avoiding the above mentioned drawbacks and while making it possible to displace the ballast for the crane work and street work without having to resort to expensive and complicated mechanical devices.

These objects and other objects and advantages of the invention will appear more clearly from the following specification in connection with the accompanying drawings, in which.

Figure 1:
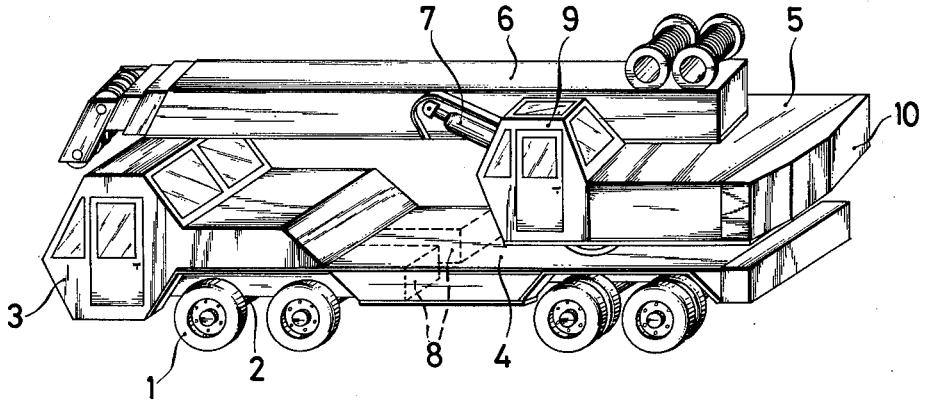
FIG. 1 is an isometric view of a crane vehicle according to the invention as seen in driving position.
Figure 2:
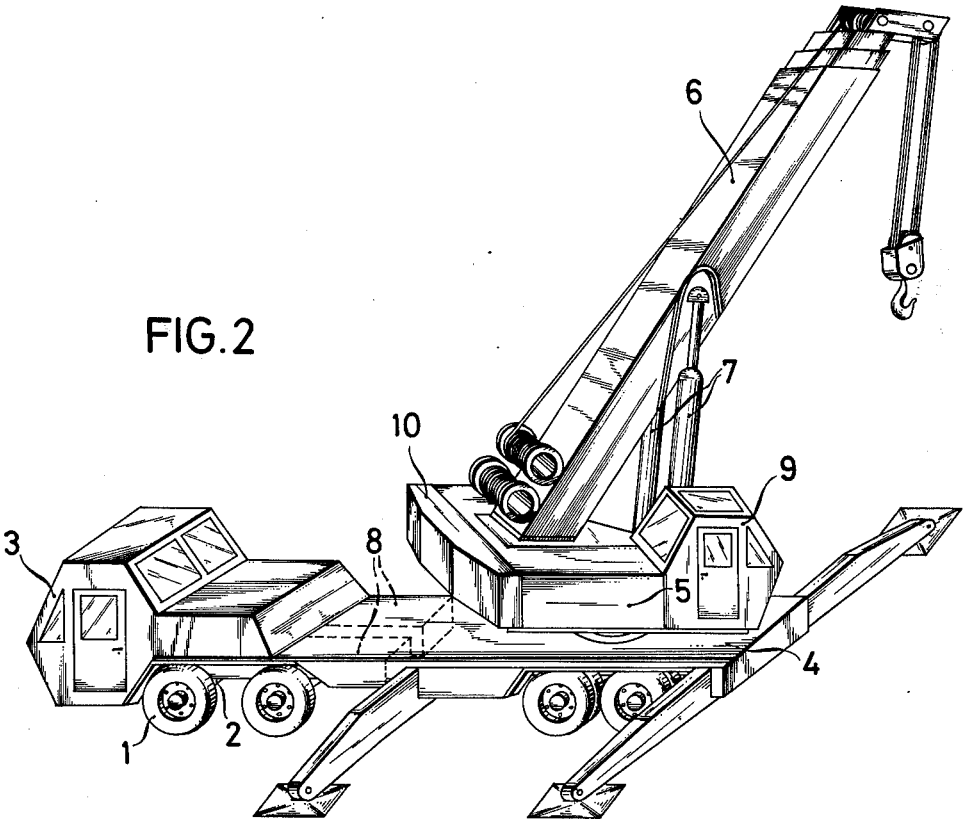
FIG. 2 represents an isometric view of a crane vehicle with moved-out supporting devices and with the crane in operative position.
Figure 3:
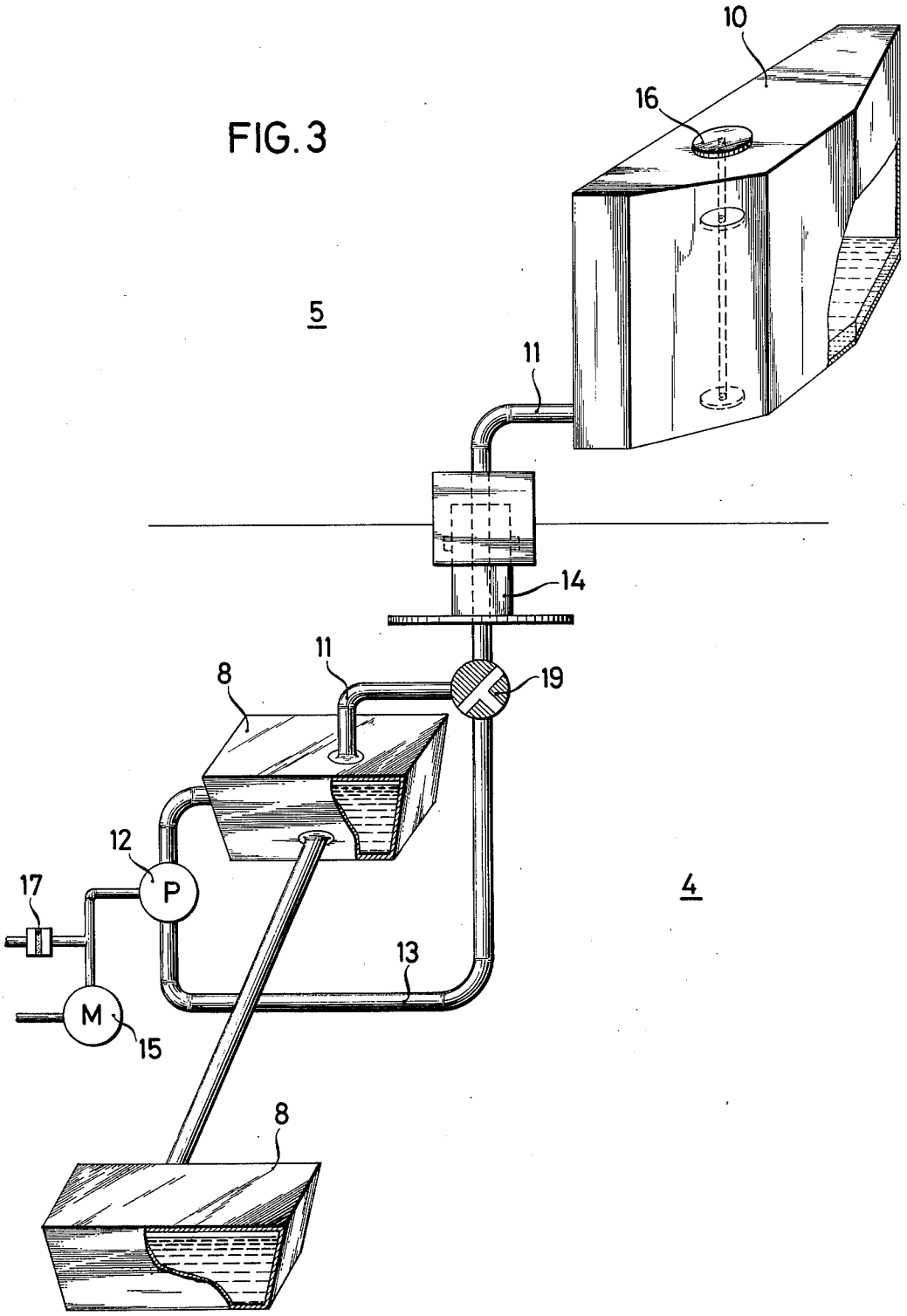
FIG. 3 illustrates a fluid container for use in connection with the present invention, which is equipped with a device for pumping the fluid through a rotatable passage arranged between the upper and lower carriage.
Figure 4:
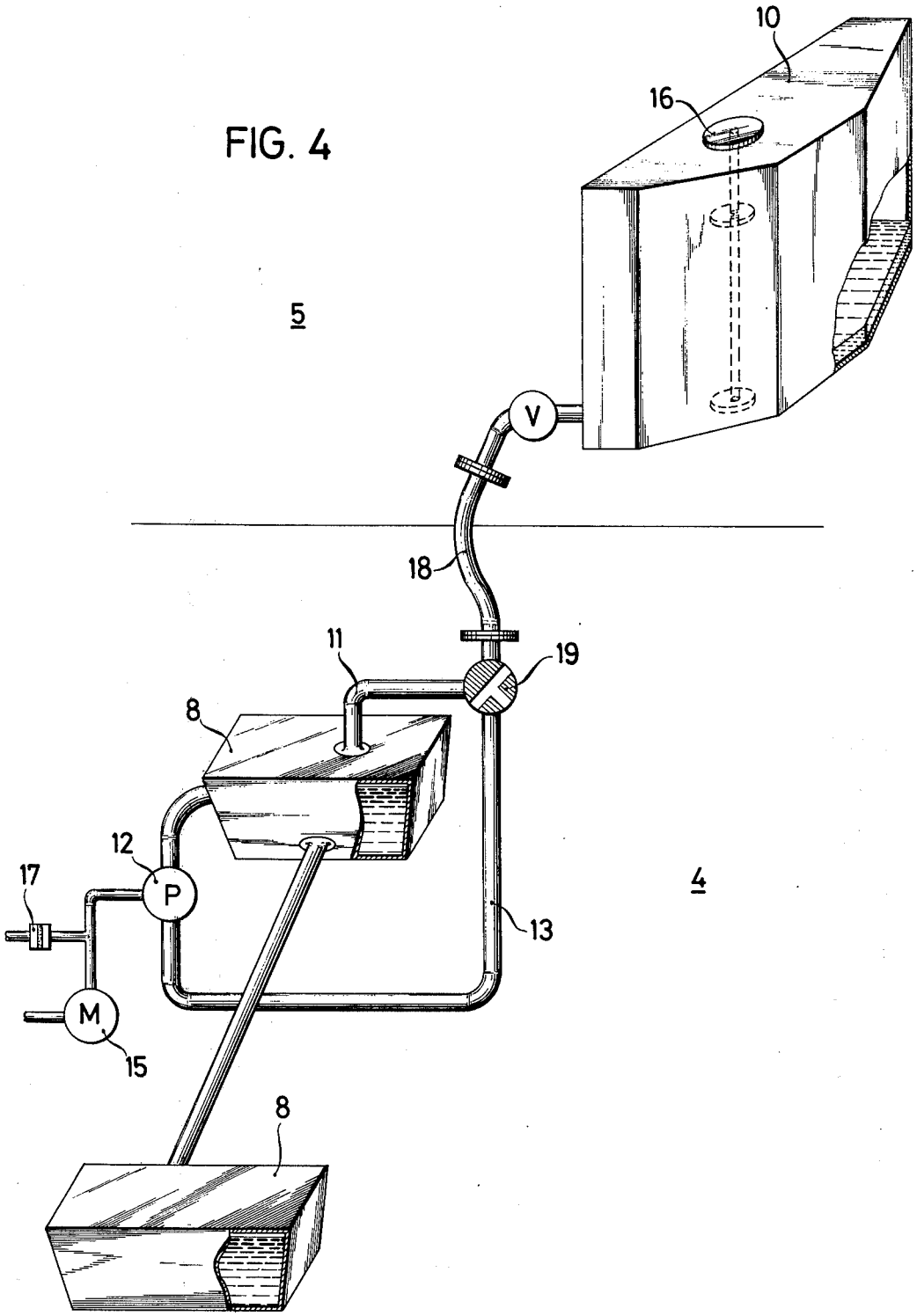
FIG. 4 is a view similar to that of FIG. 3 and differs from the latter inasmuch as the liquid is pumped through a detachable hose located between the upper and lower carriages.

The device according to the invention for equalizing the axle loads of a mobile crane according to the invention is characterized primarily in that in the front portion of the lower carriage there are provided two fluid containers whereas at the free end of the upper carriage there is arranged one fluid container and a pump which is driven by the motor serving for driving the vehicle, said pump communicating through conduits with the fluid containers.

According to a further development of the invention, the quantity of liquid serving for equalizing the axle loads is as ballast pumped into the counter weight containers of the upper carriage.

Referring now to the drawings in detail, the crane vehicle is movable on the axles 2 which are provided with wheels equipped with rubber tires. When driving through streets, the vehicle is operated from the driver's cab 3 which is arranged on the lower carriage 4. The telescopic boom 6 is rotatably journalled on the upper carriage 5. The lifting of the telescopic boom 6 when the crane is in operation, is effected by means of the hydraulic cylinder-piston system 7 linked to the upper carriage 5. The fluid containers 8 are arranged on the lower carriage 4 in a favorable center of gravity position. That end of the upper carriage 5 which is located opposite to the operator stand 9 for the telescopic boom 6 is equipped with the fluid containers 10.

The fluid containers 8 are interconnected by a conduit 11. Connected to the conduit 13 is a pump 12 which is driven by the motor or engine 15. The conduit 13 leads from pump 12 through a rotatable connection 4, which is located between the lower carriage 4 and upper carriage 5, to the fluid container 10 which is arranged in the upper carriage 5. By means of the three-way valve 19, it is possible to convey the liquid which serves as ballast either from the container 8 into the container 10 or the said liquid may be discharged in the reverse manner. By means of a level control 16, it is possible to control the minimum and maximum liquid level while an electric switch operable by the fluid makes effective and ineffective the clutch 17 which is arranged between the motor 15 and the pump 12.

It is, of course, to be understood that the present invention is not limited to the specific showing in the drawings. Thus, instead of guiding the liquid serving as ballast through the rotatable passage, the liquid may also by means of a disengageable hose connection 18 be passed from the upper carriage 5 to the lower carriage 4. In this connection, the hose conduit 18 can selectively be connected to the pump 12 or to the liquid container 8. The number of containers may vary, depending on the structural requirements and their specific differences over the arrangement shown in the drawings.

What I claim is:

1. A mobile crane which includes in combination: a lower carriage having a front section, an upper carriage rotatable with respect to said lower carriage and having a first end portion adapted to support an operator's stand and also having a second end portion opposite said first end portion, first fluid storage container means arranged at said front section of said lower carriage, second fluid storage container means arranged at said second end portion of said upper carriage and automatically pivoted along with movement of the crane, conduit means leading from said first to said second fluid storage container means, and pump means interposed in said conduit means and operable selectively to pump fluid from said first fluid storage means to said second fluid storage container means thereby permitting liquid which serves for equalizing axle loads of the crane both when driving over roads to be pumped to said second fluid storage container means to serve as ballast and counterweight effective also during standstill hoisting operations of said crane operational about 360° of movement thereof.

2. A crane in combination according to claim 1, which includes motor means for selectively driving said crane and said pump means.

3. A crane in combination according to claim 1, which includes a three-way valve interposed in said conduit means and operable to release fluid from said second fluid storage container means into said first fluid storage container means.

4. A mobile crane which includes: a lower carriage having a front section, an upper carriage having a first end portion adapted to support an operator's stand and also having a second end portion opposite said first end portion, first fluid storage container means arranged at said front section of said lower carriage, second fluid storage container means arranged at said second end portion of said upper carriage, conduit means leading from said first to said second fluid storage container means, pump means interposed in said conduit means and operable selectively to pump fluid from said first fluid storage means to said second fluid storage container means thereby permitting liquid which serves for equalizing axle loads of the crane when driving over roads to be pumped to said second fluid storage container means to serve as ballast and counterweight during hoisting operations of said crane, and means pivotally connecting said upper carriage to said lower carriage and being provided with passage means therethrough, said conduit means passing through said passage means.

5. A crane according to claim 4, in which said conduit means includes flexible hose means between said upper and lower carriage means.

6. A crane according to claim 4, which includes fluid level control means associated with said second fluid storage container means and operable to control the liquid level in said second fluid storage container means.

* * * * *